United States Patent [19]

Kopp et al.

[11] Patent Number: 4,469,427

[45] Date of Patent: Sep. 4, 1984

[54] DEVELOPING STATION FOR DEVELOPING CHARGE IMAGES GENERATED ON A CHARGE IMAGE CARRIER

[75] Inventors: Walter Kopp, Taufkirchen; Karl-Heinz Saalmueller, Munich, both of Fed. Rep. of Germany

[73] Assignee: Siemens Aktiengesellschaft, Berlin and Munich, Fed. Rep. of Germany

[21] Appl. No.: 369,834

[22] Filed: Apr. 19, 1982

[30] Foreign Application Priority Data

Apr. 30, 1981 [DE] Fed. Rep. of Germany ..... 3117296

[51] Int. Cl.[3] ..... G03G 15/00

[52] U.S. Cl. ..... 355/3 DD; 118/657; 355/3 R

[58] Field of Search ..... 355/3 DD, 3 R; 118/652–658; 430/122

[56] References Cited

U.S. PATENT DOCUMENTS

| | | | |
|---|---|---|---|
| 3,791,730 | 2/1974 | Sullivan | 355/3 DD |
| 3,883,240 | 5/1975 | Ito et al. | 355/3 DD |
| 3,982,830 | 9/1976 | Daniels et al. | 355/3 DD |
| 4,026,241 | 5/1977 | Takebe et al. | 118/653 |
| 4,168,901 | 9/1979 | Ito et al. | 355/3 DD |
| 4,213,617 | 7/1980 | Salger | 355/3 DD |
| 4,226,524 | 10/1980 | Hashimoto | 355/3 DD |
| 4,361,396 | 11/1982 | Uchida | 355/3 DD |

*Primary Examiner*—R. L. Moses

*Attorney, Agent, or Firm*—Hill, Van Santen, Steadman & Simpson

[57] ABSTRACT

In a developer station for an electrophotographic printing or copying machine, there is provided apparatus which effects a more reliable uniform inking of charge images contained on a charge image carrier and which prevents spotting of printed images due to the unintended presence of carrier particles on the charge image carrier. The apparatus includes an evacuator device disposed at the air gap between the developer drum and charge image carrier preceding the inking gap formed therebetween for removing toner deposits which may accumulate at that portion of the developer station housing. A magnetic drum is disposed at the carrier exit end of the station housing for removing carrier particles from the charge image carrier which may have unintentionally become attached to the carrier surface in the area of the inking gap. Devices including an adjustable doctor strip and narrow developer transport channel along the developer drum are provided to control the layer thickness of mix being transported from the mix supply pile in the housing to the inking gap. A mixing screw arrangement is disposed in the developer station housing for blending fresh toner with used developer mix and conducting the enriched mix through the developer station in such a manner that sufficient toner concentration is maintained in the mix throughout developer operation. A sealing plate is disposed along the carrier exit end of the developer station housing to prevent toner dust from emerging from the housing to contaminate the charge image carrier. A plate is disposed between the body of mix in the housing and the developer drum to keep the mix from pressing against the drum and interfering with its rotation.

22 Claims, 2 Drawing Figures

12
II
50
34
24
32
48
26
30
18
28
42
10
36
38
44
60
20
14
64
68
62
16
22
66
70
N
S

DEVELOPING STATION FOR DEVELOPING CHARGE IMAGES GENERATED ON A CHARGE IMAGE CARRIER

RELATED APPLICATIONS

This application concerns subject matter which relates to the following commonly assigned U.S. patent applications, all filed Apr. 19, 1982:

Ser. No. 369,832 entitled "Mixing Device for Blending a Developer Consisting of Carrier Particles and Toner", Ser. No. 369,833 entitled "Developing Device for Developing Charge Images on a Charge Image Carrier", and Ser. No. 369,897 entitled "Device for Removing the Developer Mix from a Developing Station".

BACKGROUND OF THE INVENTION

The invention relates to apparatus for use in a developer station where charge images formed on a charge image carrier passed through the developer station are inked in accordance with magnetic brush principles with a developer mix of toner and carrier particles.

Typically non-mechanical printing or copying machines function according to electrophotographic principles, wherein electrostatic latent images of characters to be printed are generated on a recording medium, such as a photoconductive drum. The drum has on it a semi-conductor layer of photo-electrical or di-electrical material on which electrostatic charge images of the characters to be printed or copied are generated. These electrostatic images are subsequently inked with a toner powder, usually a black powder, in a developer station. The toner images are subsequently transferred to sheet paper on which they are fixed. The developer station typically includes at least one developer unit generally referred to in the art as a magnetic brush developer. The magnetic brush developer, as a rule, contains a magnetic brush or drum mounted for rotation so as to continually bring developer mix, consisting of iron carrier particles and toner particles, into contact with the electrostatic images recorded on the photoconductive drum surface. The charge images are inked by adherence of toner particles to the charge images, due to electrostatic forces.

A developer station assembly which functions in accordance with magnetic brush principles is disclosed in U.S. Pat. Nos. 3,784,297 and 3,883,240. There, developer mix is conducted past the revolving surface of a photoconductive drum carrying the charge images to be generated by means of two rotating magnetic or developer drums. A developer mixing device, including two side-by-side rotary screws disposed along the floor of the developer station housing in intimate contact with the supply of developer mix, is provided to continuously distribute the toner and carrier particles of the mix and blend in fresh toner added to the main body of mix to make up for toner spent in the charge image inking process.

A significant problem, especially with respect to high-speed copying and printing machines, is that of developing or inking the latent charge images on the charge image carrier simultaneously along the entire width of the carrier with consistent inking densities throughout developer operation and high resolution. This requires a high level of effective performance in the developer station since typical high-speed image carriers pass charge images through the developer station at speeds up to 0.7 m/sec. Furthermore, it is necessary to guarantee that only the charge images are inked. A sporadic, unintentional spotting or otherwise contamination of the charge image carrier surface with clumps of toner or entrained toner deposits must be avoided. Despite all of these requirements, the developer station in a high-speed printer or copying machine must also operate reliably over time such that servicing is only rarely necessary to eliminate frustrating and inefficient downtime.

An object of the present invention is to provide a developer station with apparatus such that, even in the case of high-speed printers or copiers, charge images on the charge image carrier are consistently and reliably inked uniformly over the entire width of the carrier with constant inking densities and high resolution and contamination of the background areas on the charge image carrier due to spotting is avoided with a high degree of certainty.

SUMMARY OF THE INVENTION

In a developer station for an electrophotographic printing or copying machine, there is provided a housing which is partitioned into a principal chamber adjacent the entry area of the charge image carrier and a mixing chamber disposed in the area of the developer station where the charge image carrier exits. Preferably, a single developer or magnetic drum is disposed for rotation within the principal chamber for conducting developer mix, consisting of toner and carrier particles, upwardly from the floor of the principal chamber to an inking nip or gap between the developer drum and image carrier where charge images are developed.

The housing is formed with a wall concentric about a portion of the developer drum for defining a narrow transport channel therebetween through which developer mix is conducted upwardly from the housing floor to the inking gap, thus minimizing the possibility of toner clumps arising along the transport path of the mix. Disposed within the housing are rotary screws, one in the principal chamber and one in the mixing chamber, for continuous mixing of the toner and carrier particles and for blending fresh toner into the mix. The mixing chamber is disposed at a level elevated from the mixing screw in the principal chamber and is adapted to receive a portion of the developer mix particles spilled off the rotating developer drum as well as the supply of fresh toner into the developer station. The rotary screw disposed in the mixing chamber blends the fresh toner with the used developer mix particles received from the drum in a manner which prevents the fresh toner from floating on the top of the conveyed mass and prevents billowing of toner dust and particles which would emerge from the developer station. The mixing chamber screw communicates with the principal chamber through a discharge opening formed in a partition wall. The rotary screws together prevent deposit of toner clumps on housing parts of the developer station.

In order to prevent vitiation of the developer drum surface as it rotates through the principal chamber adjacent the main body of mix, a curved protection plate is disposed between the principal chamber screw and the developer drum which holds back the mix pile from pressing against the drum surface.

The developer station housing is further provided with an adjustable doctor means in the form of a rotary semicircular or halved shaft disposed longitudinally with the drum at the intake area of the mix transport channel to control the layer of thickness of developer being conducted by the drum. Relative rotation of the shaft serves to narrow or widen the intake opening to the transport channel such that the layer height or thickness of developer being conducted by the drum can be set as desired.

There is further provided an evacuator assembly connected to a source of suction pressure disposed within an air gap formed between the charge image carrier and the upper end of the developer drum immediately preceding the inking gap which serves to siphon loose toner dust or particles, thus avoiding undesirable contamination of the image carrier surface. The evacuation device is preferable formed with a plurality of suction chambers disposed in intimate series relationship along the longitudinal length of the air gap, such that a continuous suction opening is disposed along the air gap. The suction chambers are nozzle shaped, narrowing toward evacuation lines disposed away from the air gap to produce optimal siphon flow of toner particles out of the gap.

The emergence of toner dust or particles and the deposit of toner on the carrier exit end of the developer station housing adjacent the mixing chamber is prevented by means of a toner dust sealing plate which forms a closed end sidewall of the mixing chamber extending upwardly from the developer station housing to a point in close proximity with the charge image carrier. The upper end free edge of the sealing plate is formed as a cutting edge surface which acts to level the layer of toner particles affixed to the charge images on the carrier.

Carrier particles which may have become attached to the image carrier surface are prevented from emerging from the developer station with the carrier by a magnetic drum assembly rotatably disposed at the carrier exit end of the developer station. The magnetic drum serves to attract carrier particles from the image carrier and is rotatable adjacent a cleaning plate or slide which acts to remove the retrieved carrier particles from the magnetic drum for deposit into a collecting container.

The apparatus of the present invention enables the developer station to achieve a consistently clean inking of the charge images on the carrier. This effect is further promoted by application of an electrical potential to the developer drum, which is smaller than the potential of the non-charged areas on the charge image carrier but greater than the potential of the carrier particles in the developer mix.

DESCRIPTION OF THE PREFERRED EMBODIMENT

Figure 1:
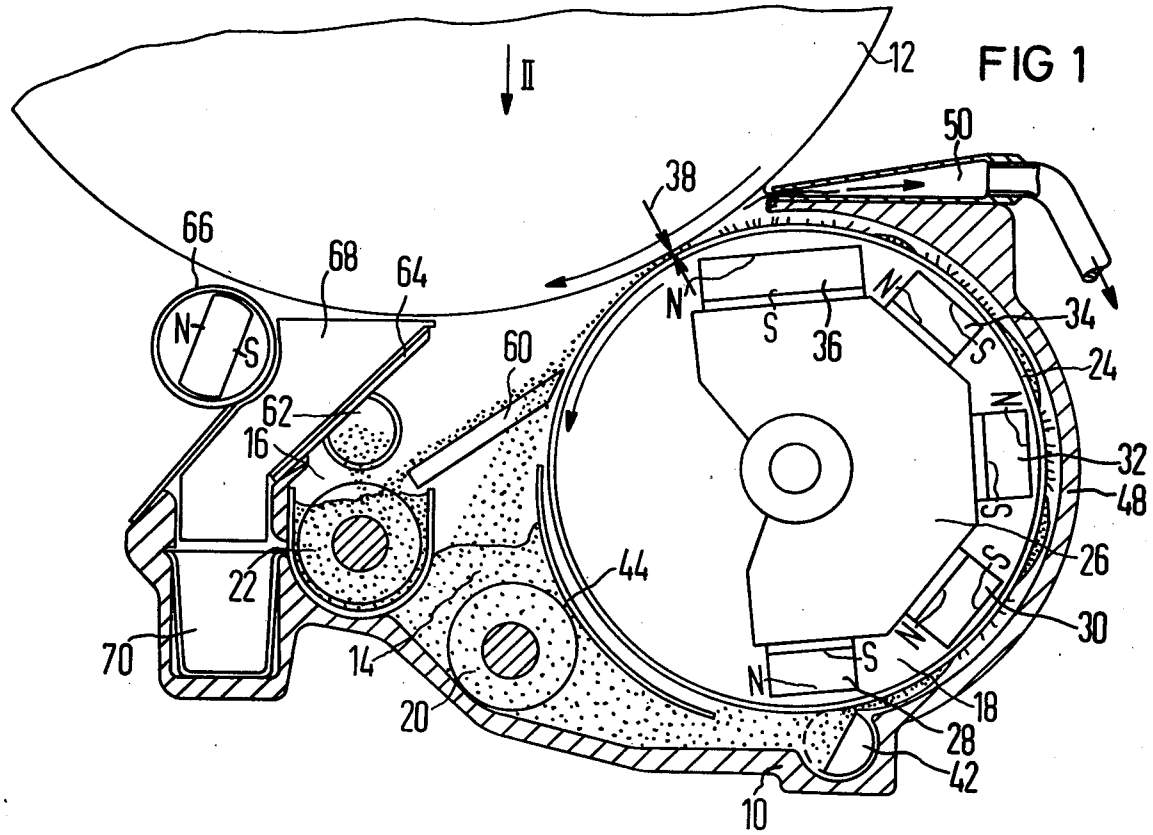
FIG. 1 is a schematic, side elevational cross-sectional view of a developer station constructed in accordance with the present invention.

FIG. 1 illustrates a developer station 10 for use in an electrophotographic printing or copying machine. A charge image carrier 12 in the form of a photoconductive drum is mounted for rotation in the machine in the direction indicated by the arrow for conducting charge images from suitable charging stations (not shown) to the developer station 10 for inking, and then to suitable transfer and cleaning stations (not shown). The developer station housing is segregated by a suitable laterally extending wall into a principal chamber 14 and a mixing chamber 16, wherein the mixing chamber 16 takes up significantly less space than the principal chamber 14. A magnetic or developer drum 18 is disposed for rotation in the principal chamber 14 for conducting developer mix particles, consisting of toner and finally divided iron carrier particles, from a main body disposed on the floor of the principal chamber 14 into contact with charge images arising on the surface of the carrier drum 12. That portion of the developer mix carried by the developer drum 18 which does not adhere to the carrier drum 12 spills off under the influence of gravity from the upper end of the drum 18 into the principal chamber 14. A portion of the spilled back developer mix falls directly into the principal chamber 14 and the remaining further portion of the spilled back mix is conducted into the mixing chamber 16 along a downwardly angled scraping plate 60 disposed between the upper end of the developer drum 18 and the lateral partition wall defining the inner end of the mixing chamber 16.

For continuous mixing of the toner and carrier particles of the developer mix within the developer station, there is provided a mixing assembly comprising a first rotary screw 20 disposed along the floor of the station housing longitudinal with the developer drum 18 and a second rotary screw 22 disposed in the mixing chamber 16 with a longitudinal axis parallel to that of the first screw 20. The mixing chamber 16 along with its rotary screw 22 is located in the developer station at a level elevated from the first screw 20 and an opening is formed in the partition wall dividing the mixing chamber from the principal chamber 14 to permit particle flow communication between the mixing chamber 16 and the principal chamber 14.

The main body of developer mix situated in the principal chamber 14 contains a toner concentration level sufficient for inking of charge images. This main body of mix is distributed along the length of the developer drum 18 for conduction by the drum upwardly within the station housing and passage through the inking gap 38. At the inking gap, toner particles within the developer mix transfer to the latent charge images formed on the carrier 12. Subsequently, as the drum 18 conducts the developer mix through the gap 38, the unused developer spills back into the principal chamber 14 onto the main body of mix. The first screw 20 serves to convey developer, including the spilled back developer, axially along the length of the developer drum 18, as shown by the arrow in FIG. 2, in a progressive fashion. Developer mix, including the spilled back developer, is again picked up by the developer drum 18 at a position further along the length of the drum 18, transported to the inking gap 38, and spilled back into the principal chamber 14. This process is repeated a number of times until the spilled back developer mix reaches the far end of the developer drum 18. Toner concentration among the carrier particles of the developer mix is set such that the concentration remains sufficient during movement of the mix between the initial or lead end of the rotary screw 20 and its far end to permit repeated transfers of developer mix through the inking gap 38 for development of the charge images on the carrier 12. By the time the developer mix has arrived at the far end of the drum 18, the toner concentration in the mix is at a near-depleted level. This mix adjacent the far end of the drum 18 is conducted by the drum to the inking gap 38 for a final pass along the image carrier 12. Thereafter, these mix particles passing through the inking gap fall onto the scraper plate 60 over which they are conducted into the lead end of the mixing chamber 16. The lead end of the mixing chamber 16 is located at the opposite end of the station housing from the lead or initial end of the first screw 20 since the conveying direction of the second screw 22 in the mixing chamber is in the opposite direction to that of the first screw 20, as shown by the arrows in FIG. 2.

In the mixing chamber 16, the toner-depleted developer retrieved from the far end of the developer drum 18 is immediately mixed with fresh toner particles passing into the mixing chamber 16 from a feed opening 62 connected to a suitable toner reservoir means. The feed opening 62 is located substantially overlying the discharge end of the scraping plate 60 such that the new toner and old developer intimately mix immediately upon deposit in the mixing chamber, which prevents the new toner from floating on top of the used developer contained in the mixing chamber. The second screw 22 serves to intimately mix the fresh toner and used developer particles into a high toner concentration developer blend during transport along the mixing chamber 16. This blend is eventually passed from the mixing chamber 16 through the discharge opening formed in the partition wall under the influence of gravity into the principal chamber 14 for deposit adjacent the lead end of the rotary screw 20. In order to allow sufficient mixing time in the chamber 16 and in order to position the high toner concentration mix at the lead ends of the developer drum 18 and rotary screw 20, the discharge opening in the mixing chamber partition wall preferably does not extend more than approximately one-third along the length of the partition wall.

The first and second rotary screws 20 and 22 mill developer particles to a degree that the tribo-electrical characteristics of the carrier particles are generated and substantially maintained in the mix. In this manner, optimum charge attraction conditions exist between the toner and carrier particles.

The developer drum 18 comprises a hollow cylinder 24, which may, for example, be made of aluminum having a milled exterior surface, mounted for continuous rotation within the station housing. A fixed magnet assembly 26 is disposed inside of the hollow cylinder 24 comprising a plurality of individual permanent magnet rows 28, 30, 32, 34, and 36. The magnet rows, each being disposed longitudinal with the cylinder 24, are supported on a stator support 26 in series with one another extending about slightly more than half of the circumference of the cylinder 24. The polarity of the magnet rows consecutively alternates, as shown by the N and S designations in FIG. 1, from row to row in order to obtain a closed magnetic field line progression along the surface of the cylinder 24. This magnetic field line defines a transport path for developer mix along the circumference of the rotating cylinder 24, whereby developer mix, consisting of the ferromagnetic carrier particles and toner adhering thereto as a result of electrostatic forces, migrates along the magnetic field line in the direction of rotation of the cylinder 24 from the floor of the station housing to the inking gap 38.

A first magnet row 28 is disposed along the bottom end of the rotating cylinder 24 facing the floor of the station housing. This first magnet row serves to attract developer into the mix transport path along the cylinder 24. The next succeeding magnet rows 30, 32, and 34 serve to conduct the developer particles along the transport path to the upper end of the cylinder 24. The final magnet row 36 is disposed at the upper end of the cylinder 24 and formed of a width substantially greater than that of any of the remaining magnet rows. In accordance with the preferred embodiment, the width of the final magnet row 36 is approximately twice that of any of the other magnet rows, the other magnet rows being formed of a substantially common width dimension. Furthermore, the longitudinal centerline of the final magnet row 36 is disposed angularly offset from the narrowmost point of the inking gap 38 in a direction opposite to the direction of rotation of the hollow cylinder 24. This positioning as well as the increased width of the final magnet row serves to cause a homogeneous, uniform distribution of developer particles immediately proceding passage through the inking gap 38. This distribution of developer particles evenly across the length of the hollow cylinder 24 results in uniform inking densities and high resolution in the developed charge images during developer operation. In accordance with the preferred embodiment, the longitudinal centerline of the final magnet row 36 is spaced at an angle of approximately 25° taken from the longitudinal centerline of the cylinder 24 with the narrowmost point in the inking gap 38 and the furthermost edge of the magnet row 36 in the direction of rotation of the cylinder 24 precedes or stops short of the narrowmost point of the gap 38. This construction serves to enable the developer particles to even out or densify on the surface of the hollow cylinder 24 immediately prior to passage through the inking gap 38. Not only is inking quality of the charge images much improved by virtue of this developer drum construction, but also very few carrier particles remain adhering to the charge image carrier 12 as a result of the pre-distribution of mixed particles over the final magnet row 36 just prior to the inking step.

Preferably, each magnet row is made up of a consecutive or juxtaposed series of individual permanent magnets. In order to prevent collapses of the magnetic induction level at the interfaces between the individual magnets in each row, each magnet row is seated on a respective continuous soft iron support plate which is secured to the stator 26. The effect of this soft iron support plate is that the magnetic induction field along the entire length of each magnetic row remains substantially level.

Optimum inking of the charge images on the charge image carrier 12 is achieved when the inking gap 38 is of a very small distance, such as in the range of 1 mm through 1.5 mm, and when the developer mix conveyed through the gap 38 is arranged with substantially uniform density or distribution fully along the length of the developer drum 18. The layer thickness of developer mix being conducted by the rotating cylinder 24 must be such that the latent charge images are sufficiently inked with toner and, on the other hand, thin enough that the surface of the charge image carrier 12 is not damaged due to too much pinching. To meet these requirements, the developer station is provided with devices for adjusting the thickness layer of developer mix transported on the cylinder 24. One such device comprises an adjustable doctor or leveling strip element in the form of a semi-circular or halved shaft 42 disposed for rotation and longitudinal with the developer drum 18 adjacent the floor of the station housing. The leveling shaft 42 is positioned beneath the first magnet row 28 and serves to define an intake opening to the developer transport path with the lower end of the cylinder 24. Selective rotation of the halved shaft 42 serves to widen or narrow the inlet opening to the transport path, thus controlling the rate and layer thickness of developed mix being carried by rotatable cylinder 24 to the inking gap. Rotation of the shaft 42 also enables the leveling strip to compensate for the positional tolerances of the developer drum 18 within the station housing and scatters of the magnetic induction of the magnet row 28 both of which can affect the amount of developer mix passing from the main body of mix to the transport path.

A further device for controlling the amount of developer mix being conveyed by the drum 18 to the charge image carrier 12 is in the form of a curved housing wall 48 concentric about the cylinder 24 and magnet rows substantially along the mix transport path. During movement of developer mix on the drum 18, toner can release from the carrier particles and deposit on nearby stationary walls presenting the danger that toner accumulations will build up and then break off in clumps which could cause spotting or inking clumping in the developed images on the carrier 12. Accordingly, the distance between the adjacent circumference of the cylinder 24 and the housing wall 48 is small enough to define a mix transport channel 46 therebetween such that the conducted layer of developer always brushes lightly against the housing wall 48, preventing toner agglomeration or clumping along this wall. The transport channel 48 is, on the other hand, wide enough to accommodate the desired layer thickness of developer to be transported to the inking gap 38.

Figure 2:
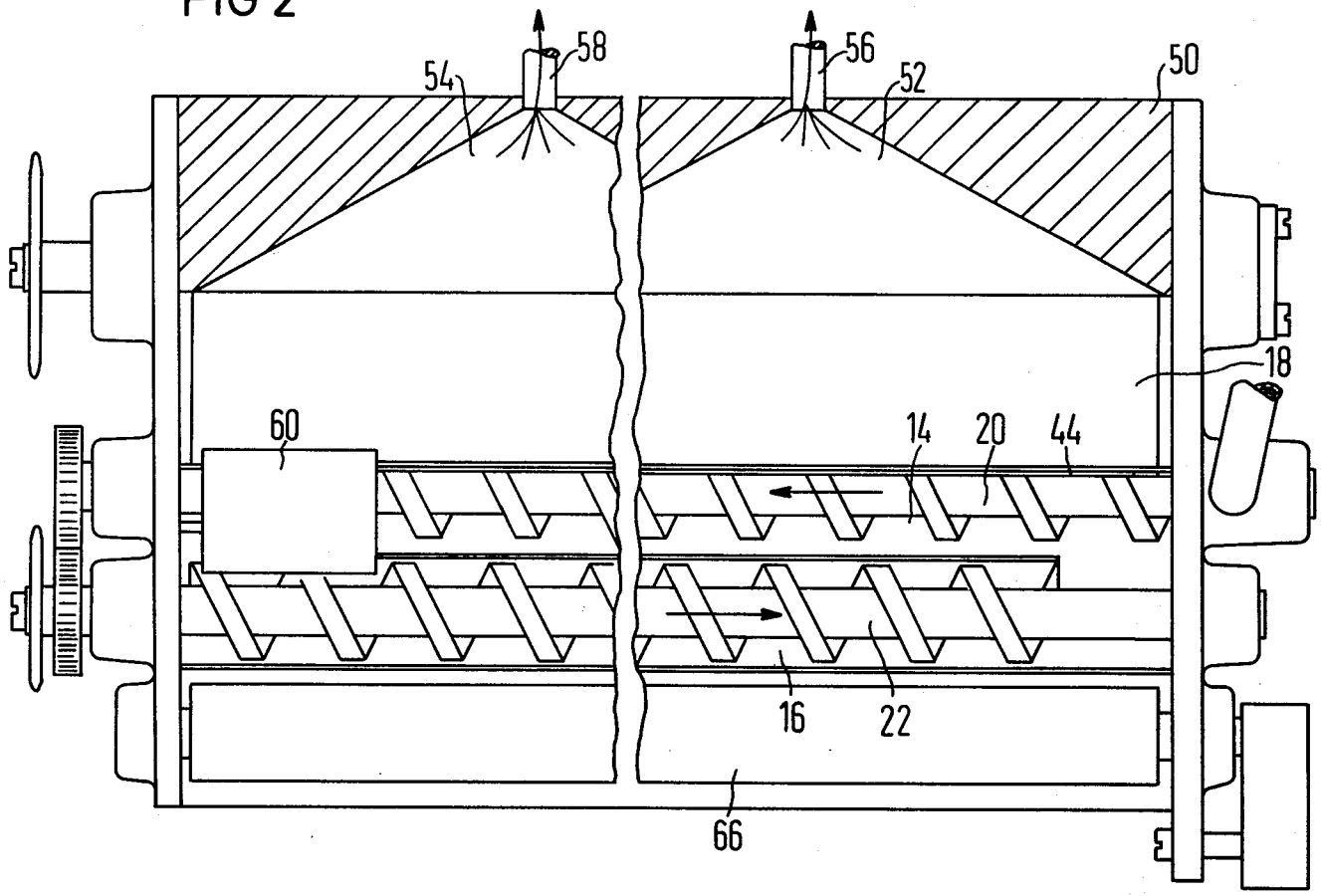
FIG. 2 is a partial plan view of the developer station of FIG. 1 taken in the direction II of FIG. 1.

A further location at which toner can build up in deposits occurs at the upper end edge of the housing wall 48, which is spaced across an air gap from the surface of the carrier drum 12 in order to permit the drum 12 to rotate freely into the developer station 10 forming the inking gap 38. This upper end free edge of the housing wall 48 extends out of the transport path of developer such that subsequent developer particles do not continuously brush this edge clean. A toner accumulation can form at this edge, break off when it reaches an appropriate size, and be transported by the drum 18 into the inking gap 38 where it can contaminate the developed charge images as a black spot or spots. In order to prevent toner accumulations from being formed in this air gap, there is provided an evacuation assembly 50 disposed on the top surface of the housing wall 48 and connected to a suitable source of suction pressure for siphoning off toner which becomes suspended in the air gap between the wall 48 and the image carrier 12 such that toner deposits are prevented. As shown in FIG. 2, the evacuation assembly comprises a plurality of suction chambers 52 and 54 formed side-by-side in a housing longitudinal with the developer drum 18. These suction chambers are intimately consecutive with one another at their inlet openings facing into the air gap, such that a uniform vacuum pressure is generated along the entire length of the air gap. This vacuum effect is further enhanced in that the suction chambers are each nozzle shaped, converging in plan profile away from their inlets toward respective collection line inlets 56 and 58 centrally positioned within the corresponding suction chambers, as shown in FIG. 2, in order to achieve a high evacuation velocity within the chambers. The evacuation lines are connected with the source of suction pressure, which may be in the form of a manifold connected to a blower inlet. In order to prevent blockage of particles collected in the chambers, the lateral cross-section of each chamber expands in the direction away from its inlet as shown in FIG. 1.

The useful life of a main body of developer mix contained in the developer station 10 depends, among other things, on the amount or volume or mix particles piled in the housing. Accordingly, as much developer mix as possible is situated in the principal chamber 14. In order to prevent this pile of developer in the principle chamber from pressing against the surface of the developer drum 18 over too large an area and thus present frictional forces interfering with the drive rotation of the drum 18, a curved protection plate 44 is disposed longitudinally with the lower end of the hollow cylinder 24 within the principal chamber 14. The plate 44 is disposed at a slight distance spaced from the rotating circumference of the developer drum 18. The protection plate 44 serve to prevent the pile of developer mix from leaning against the drum cylinder 24 and thus serves as an interior stop wall against which the upper end of the mix pile is disposed. The plate 44 terminates at a lower end short of the lowermost area of the drum cylinder in the proximity of the leveling strip element 42 providing an open feed area where developer may contact the drum preceding the inlet opening to the developer transport channel. In order to minimize developer particles spilling off the upper end of the rotating cylinder 24 from proceeding between the protection plate 44 and the adjacent circumference of the cylinder, the distance between the plate 44 and the cylinder 24 decreases in the upward direction from the lower end of the plate so that a relatively narrowed gap is formed between the upper end of the plate 44 and the developer drum. For example, the gap between the plate 44 and the drum may increase from 1 mm at the upper end of the plate to 3 mm at the lower end of the plate proceeding in the direction of rotation of the drum. In this manner, substantially no mix particles pass into this gap between the drum and upper end of the plate 44 which could accumulate in the gap and lead to jamming of the rotational drive of the developer drum 18.

In order to prevent the emergence of toner dust or particles from the developer station 10 at that end of the housing adjacent the mixing chamber 16 where the charge image carrier 12 exits the developer station, there is provided an upwardly extending sealing plate 64 with its upper free end disposed in close proximity with the surface of the drum 12. In accordance with the preferred embodiment, this upper edge of the plate 64 extends to approximately 1.5 mm from the adjacent surface of the carrier drum 12. The upper edge of the sealing plate 64 is formed with a cutting or doctor-shaped lip proceeding partially along the surface of the drum 12 in order to keep toner deposits or clumps from forming along the upper edge of the plate.

During the inking process, carrier particles often sporadically release from the magnetic field of the developer drum 18 and become attracted to the surface of the charge image carrier 12 due to electrostatic forces. This effect can lead to blank areas in printed images when the toner from the charge image carrier is transferred to sheet paper. In order to prevent carrier particles from being conducted out of the developer station 10 on the charge image carrier to the subsequent transfer station, a magnetic drum comprising a hollow cylinder disposed for rotation about an axis longitudinal with the carrier drum 12 and a permanent magnet disposed interiorly of the cylinder, is positioned adjacent the surface of the drum carrier 12 at the carrier exit end of the developer station. Carrier particles contained on the charge image carrier 12 are captured on the drum cylinder during movement of the charge image carrier 12 therepast.

During printing pauses, the cylinder of the magnetic drum 66 is rotated in a direction opposite to that of the rotational direction of the charge image carrier 12 so that the captured carrier particles can be stripped from the magnetic drum. A cleaning slide 68 is disposed between the magnetic drum 66 and the toner sealing plate 64 with one end arranged adjacent the drum cylinder surface and an interior opposed end in mating engagement with the upper end surfaces of the sealing plate 64. The slide 68 is disposed for lateraly movement by engagement of suitable handle means (not shown) in a direction longitudinal with the magnetic drum 66 and sealing plate 64 for sweeping over the critical surfaces and edges to scrape off collected particles. It should be noted that toner may also deposit on the magnetic drum 66 as well as on the upper edge of the sealing plate 64. All of the collected particles accumulating on the magnetic drum 66 and the upper edge of the sealing plate 64 are scraped off by the lateral movement of the slide and fall under gravity downwardly into a collection container 70 disposed in the developer housing. The collection container 70 is mounted such that it can be emptied from time to time.

The direction of rotation of the developer drum 18 and of the charge image carrier 12 in the inking gap 38 is the same. This synchronous rotation of the drums 12 and 18 offers a significant advantage over known developer apparatus wherein the carrier surface and developer drum pass in opposite directions relative to one another in that each line of charge images on the carrier 12 faces only fresh developer mix particles having suitable toner concentration as the carrier passes into and through the inking gap. In accordance with the inventive developer station arrangement, each line of charge images on the carrier 12 is first inked with a maximum toner concentration mix and then inked with a lower toner concentration mix during passage of the carrier through the inking gap 38. Accordingly the synchronized rotation of the developer and carrier drums 18 and 12 avoids the danger of uneven inking of successive lines of charge images.

Graphic information must also frequently be printed in high-speed electrophotographic printing or copying machines. Such printing frequently requires a substantially larger charge image carrier surface. The larger surface photoconductor exhibits a uniform surface voltage which is charged by means of topical light incidence. Fixed force field lines for inking occur only at the edge areas of the charged surface. The intrinsic charge of the toner particles causes the toner to move on these field lines and therefore be deposited only in the edge areas of the charged surface. In order to prevent this, it is within the contemplation of the present invention to apply an electrical potential to the developer drum 18 by suitable electrical means which is more positive than the charged surface on the charge image carrier 12. Closed field lines on which the toner particles can move in accordance with their intrinsic charge are then formed between the developer drum 18 and the charged surface on the carrier 12 throughout the entire area of the surface. In this manner, the large area on the charge image carrier is also inked in its central spaces. It is necessary for this effect that the potential at the developer drum 18 lie below that of the background or non-charged area potential on the charge image carrier 12 since field lines would otherwise be formed from the developer drum 18 to the background potential of the charge image carrier 12 and, by so doing, the background would be disruptively inked. However, the developer drum potential must be greater than the potential of the carrier particles in the developer mix. The potential of the developer drum 18 can lie approximately 300 volts below the background potential of the charge image carrier 12 in order to obtain an optimum inking of the charged surface.

Although various minor modifications may be suggested by those versed in the art, it should be understood that we wish to embody within the scope of the patent warranted hereon all such modifications as reasonably and properly come within the scope of our contribution to the art.

We claim as our invention:

1. In a developer station having a housing containing a body of developer mix including toner and carrier particles in a first zone and a rotary developer drum in an adjacent second zone for conducting developer mix from said mix body to an inking gap between said drum and a charge image carrier passing along said housing for developing the charge images generatied on said carrier apparatus comprising:

means for preventing the emergence of toner dust from said housing first zone, means for preventing toner deposits from forming on the walls of said housing in said first and second zones, and a protection plate disposed between said mix body and said developer drum for preventing said mix body from pressing against said developer drum, said plate defining a clearance gap with the circumference of said developer drum which expands in the direction of rotation of said developer drum.

2. The apparatus of claim 1, wherein said developer drum rotates downwardly adjacent said protective plate relative to said mix body and said clearance gap is approximately 1 mm at its smallest point.

3. The apparatus of claim 1, further comprising an adjustable doctor means longitudinal with said developer drum for controlling the layer thickness of developer mix to be transported by said developer drum.

4. The apparatus of claim 3, wherein said doctor means comprises a rotary semi-circular shaft adjacent said developer drum and facing said mix body.

5. The apparatus of claim 1, wherein said means for preventing toner deposits from forming comprises a suction means connected to a source of suction pressure and having an intake opening facing longitudinally into an air space between said housing and said carrier adjacent said inking gap.

6. The apparatus of claim 5, wherein said suction means comprises a plurality of side-by-side chambers disposed longitudinall of said air space and having respective inlets defining said intake opening, each said chamber defining a space converging in plan profile away from its inlet toward a respective flow line intake connected to said source of suction pressure.

7. The apparatus of claim 6, wherein the lateral cross-section of each said chamber space expands in the direction from the respective inlet to the respective flow line intake.

8. The apparatus of claim 1, wherein said means for preventing emergence of toner dust comprises a sealing plate longitudinal with said carrier and extending upwardly adjacent said housing first zone with a free edge in close proximity to said carrier.

9. The apparatus of claim 1, further comprising wherein said carrier and developer drum pass through said inking gap in the same direction.

10. The apparatus of claim 1, further comprising a magnetic drum means disposed adjacent said carrier downstream of said inking gap for attracting carrier particles from said carrier.

11. The apparatus of claim 10, wherein said magnetic drum means comprises a cylinder disposed for rotation longitudinal with said carrier and a permanent magnet stationarily mounted within said cylinder, said cylinder being disposed along the travel path of a cleaning slide movable longitudinally of said cylinder such that collected particles can be scraped from said cylinder upon rotation of said cylinder and movement therealong of said slide.

12. The apparatus of claim 1, further comprising means for applying an electrical potential to said developer drum smaller than the potential of non-charged areas on said carrier, but greater than the potential of the carrier particles in said developer mix.

13. The apparatus of claim 12, wherein the electrical potential of said developer drum is 300 volts smaller than the potential of the non-charged areas of said carrier.

14. In a developer station having a housing containing a body of developer mix including toner and carrier particles in a first zone and a rotary developer drum in an adjacent second zone for conducting developer mix from said mix body to an inking gap between said drum and a charge image carrier passing along said housing for developing the charge images generated on said carrier, apparatus comprising means for preventing the emergence of toner dust from said housing first zone, means for preventing toner deposits from forming on the walls of said housing in said first and second zones, a partition wall dividing said first zone into a principal chamber and a mixing chamber, said principal chamber being adjacent said developer drum and containing a main body of developer mix and a first rotary screw longitudinal with said developer drum, said mixing chamber being spaced above said first screw and containing a second rotary screw, said first screw conducting developer mix along the length of said developer drum from a first end of said housing to a second opposed end, said second screw conducting developer mix from said second end of said housing to said first end, a feed opening means connected in said housing second end for supplying fresh toner to said mixing chamber, a flow means seated adjacent said housing second end for transferring a portion of the developer mix conducted by said developer drum into said mixing chamber for blending with the fresh toner, and an opening formed in said partition wall adjacent said housing first end for connecting said mixing chamber with said principal chamber.

15. The apparatus of claim 14, further comprising a protection plate disposed between said mix body and said developer drum for preventing said mix body from pressing against said developer drum, said plate defining a clearance gap with the circumference of said developer drum which expands in the direction of rotation of said developer drum.

16. The apparatus of claim 15, wherein said means for preventing emergence of toner dust comprises a sealing plate longitudinal with said carrier and extending upwardly adjacent said housing first zone with a free edge in close proximity to said carrier.

17. The apparatus of claim 16, further comprising a magnetic drum means disposed adjacent said carrier downstream of said inking gap for attracting carrier particles from said carrier.

18. In a developer station having a housing containing a body of developer mix including toner and carrier particles in a first zone and a rotary developer drum in an adjacent second zone for conducting developer mix from said mix body to an inking gap between said drum and a charge image carrier passing along said housing for developing the charge images generated on said carrier, apparatus comprising:

means for preventing the emergence of toner dust from said housing first zone and means for preventing toner deposits from forming on the walls of said housing in said first and second zones comprising a housing surface substantially concentric with said developer drum for defining a narrow transport channel therebetween through which developer mix is conducted to said inking gap such that the conducted mix brushes continually against said housing surface during transport to said inking gap.

19. In a developer station having a housing containing a body of developer mix including toner and carrier particles in a first zone and a rotary developer drum in an adjacent second zone for conducting developer mix from said mix body to an inking gap between said drum and a charge image carrier passing along said housing for developing the charge images generated on said carrier, apparatus comprising:

means for preventing the emergence of toner dust from said housing first zone including a sealing plate longitudinal with said carrier and extending upwardly adjacent said housing first zone with a free edge in close proximity to said carrier and a cleaning slide disposed for lateral movement along said sealing plate for scraping toner deposits off said sealing plate, and means for preventing toner deposits from forming on the walls of said housing in said first and second zones.

20. The apparatus of claim 19, further comprising a magnetic drum means, having a rotatable cylinder longitudinal with said carrier and a permanent magnet stationarily mounted within said cylinder, disposed adjacent said carrier on the other side of said cleaning slide from said sealing plate for attracting carrier particles from said carrier as said carrier exits said housing.

21. The apparatus of claim 20, wherein said cleaning slide is shaped adjacent said magnetic drum for scraping off particles collected theron from said carrier.

22. In a developer station having a housing containing a body of developer mix including toner and carrier particles in a first zone and a rotary developer drum in an adjacent second zone for conducting developer mix from said mix body to an inking gap between said drum and a charge image carrier passing along said housing for developing the charge images generated on said carrier, apparatus comprising:

means for preventing the emergence of toner dust from said housing first zone, means for preventing toner deposits from forming on the walls of said housing in said first and second zones, and a magnetic drum means, disposed adjacent said carrier downstream of said inking gap for attracting carrier particles from said carrier, comprising a cylinder disposed for rotation longitudinal with said carrier and a permanent magnet stationarily mounted within said cylinder, said cylinder being disposed along the travel pathe of a cleaning slide movable longitudinally of said cylinder such that collected particles can be scraped from said cylinder upon rotation of said cylinder and movement therealong of said slide.

* * * * *